US005622395A

United States Patent [19]

Shine et al.

[11] Patent Number: 5,622,395

[45] Date of Patent: Apr. 22, 1997

[54] RELEASABLE MOUNTING SYSTEM

[76] Inventors: Jerry P. Shine, 10451 Isleworth Ave., San Diego, Calif. 92126; Richard W. Harrington, P.O. Box 192, Butte Falls, Oreg. 97522

[21] Appl. No.: 414,186

[22] Filed: Mar. 31, 1995

[51] Int. Cl.[6] ..... E05C 19/10

[52] U.S. Cl. ..... 292/125; 292/210; 292/255; 292/341.17; 292/DIG. 72; 49/56

[58] Field of Search ..... 292/341.17, 203, 292/210, 125, 255, DIG. 72; 49/50, 56, 57, 141

[56] References Cited

U.S. PATENT DOCUMENTS

| | | | |
|---|---|---|---|
| 4,019,281 | 4/1977 | Weiler | 49/56 |
| 4,796,384 | 1/1989 | Warwick | 49/56 X |
| 4,856,229 | 8/1989 | Tserng | 49/56 |
| 4,897,961 | 2/1990 | Shine | 49/141 |
| 5,018,302 | 5/1991 | Kluge | 49/56 |
| 5,174,063 | 12/1992 | Lewis et al. | 49/56 X |

*Primary Examiner*—Rodney M. Lindsey

[57] ABSTRACT

According to the invention a releasable mounting system for retaining a protective cover (i.e., security grill) over an opening (i.e., window or door) in a wall of a structure is provided. The releasable system of the present invention includes a latch pin adapted to be rigidly connected to the protective cover. A housing assembly for accommodating the release means and for receiving the latch pin is also provided. The release means provided by the instant invention are pivotally mounted inside the housing assembly and include a latch member having a lever segment and a catch segment. Further provided are separation biasing means that facilitate movement of the latch member from a release position to a cocked position. Invention separation biasing means additionally facilitate movement of the latch pin away from the housing assembly when the latch member is in a release position. Also provided are remote actuating means that are connected to the latch member. Invention actuating means active the release means to drive the latch pin out of and away from the housing assembly to an unlatched position.

22 Claims, 4 Drawing Sheets

RELEASABLE MOUNTING SYSTEM

BACKGROUND OF THE INVENTION

Metal grills, guards, bars, and the like adapted to cover windows or other openings in buildings have gained substantial popularity, particularly in recent years. Such metal grills are often used for their decorative effect and may have elaborate ornamental designs. However, at least in recent times, especially when on the ground floor, window and door grills have been used for security purposes to prevent unauthorized entry into a building through its windows or other openings.

Window grills have been permanently fixed over the particular openings, however, such permanent mounting produces many undesirable results. Most importantly, permanently fixed window grills not only prevent unauthorized entry, but also prevent the occupants of the building from exiting the building through the covered window in an emergency situation. Also permanently fixed window grills make it difficult to reach the covered window from the outside for repairs or cleaning.

Due to the often disastrous consequences of permanently fixing grills over windows, a number of releasing means have been developed to enable a person to release a window grill or the like from inside a building having such grill-covered windows. The earliest releasable grills were mounted along one edge on hinged mounts with the other edge held securely in place with a lockable mount, adapted to be locked with a key or combination lock.

These locked window grills proved inadequate for several reasons. First, where key locks were used, the keys were often misplaced and could not be found in an emergency situation. Second, where combination locks were used, the combinations were easily forgotten or lost. In either type of locking grill, the locks could not be operated by children, either because they could not be reached, or because they required skill and/or strength beyond the capacity of the child.

Other releasing mechanisms were adapted to be operated from inside the building or enclosure. These devices generally used a plurality of releasable mounts and a plurality of hinged mounts adapted so that when the releasable mounts were released, the grill could swing open on the hinged mounts. The releasing mechanisms of the releasable mounts were located outside the building in an armored enclosure and were operated by means of a cable or chain that could be pulled by someone inside of the building.

The prior art releasing mounts, while an improvement over the permanently fixed, or padlocked window grills, still suffered from requiring a relatively large force to operate. The requisite for excessive force generally arose because there was substantial frictional resistance to the releasing movement in these old release mechanisms.

In some cities, the use of window grills is regulated, due to the substantial hazards that they pose with regard to emergency exit. Not only are permanently fixed grills and certain specific release mechanisms prohibited, but some regulations set out broad standards that must be met by all release mechanisms. One such regulation is that the release mechanism must not require both hands for actuation. Also, a minimum actuating force has been established in some communities, and will likely be established in others.

Thus, a need exists for a releasable mounting system for retaining a protective cover over an opening in a wall of a structure that can be released from the inside of the building or enclosure with minimal effort and without special training or knowledge. The present invention satisfies this need and provides related advantages as well.

SUMMARY OF THE INVENTION

According to the invention a releasable mounting system for retaining a protective cover over an opening In a wall of a structure is provided. The releasable system of the present invention includes a latch pin adapted to be rigidly connected to the protective cover. A housing assembly for accommodating the release means and for receiving the latch pin is also provided. The release means provided by the instant invention are pivotally mounted inside the housing assembly and include a latch member having a lever segment and a catch segment. Further provided are separation biasing means that facilitate movement of the latch member from a release position to a cocked position. Invention separation biasing means additionally facilitate movement of the latch pin away from the housing assembly when the latch member is in a release position. Also provided are remote actuating means that are connected to the latch member. Invention actuating means active the release means to drive the latch pin out of and away from the housing assembly to an unlatched position.

DETAILED DESCRIPTION OF THE INVENTION

The object of the invention is to provide a releasable mounting system for retaining protective coverings over an opening in a wall of a structure that can be released by a single motion of an actuated remote control with minimal effort or strength, or without special training or knowledge. As used herein, a "protective cover" includes security-related covers, for example, grills, guards, bars, and the like, traditional covers, for example, windows, doors, screens, and the like, as well as ornamental coverings or enclosures therefor. Another object of the instant invention is to provide a remote-controlled release-mount and mechanism for security grills and the like that have few moving parts and that is not susceptible to be released from the outside.

In a preferred form of the invention, adaptable for most covering applications, one cover side is fitted to two hinge mounts. The other cover side is engaged to two releasable mounts so that when the cover is released it is forced to swing open by the action of the release mechanism to allow emergency egress through a particular opening.

Another preferred part of the invention is a push-plate assembly mounted inside the structure. The push-plate assembly is adapted for imparting a pulling motion to a conduited cable connected to a latch means situated in the housing of the release mounts above.

Figure 1:
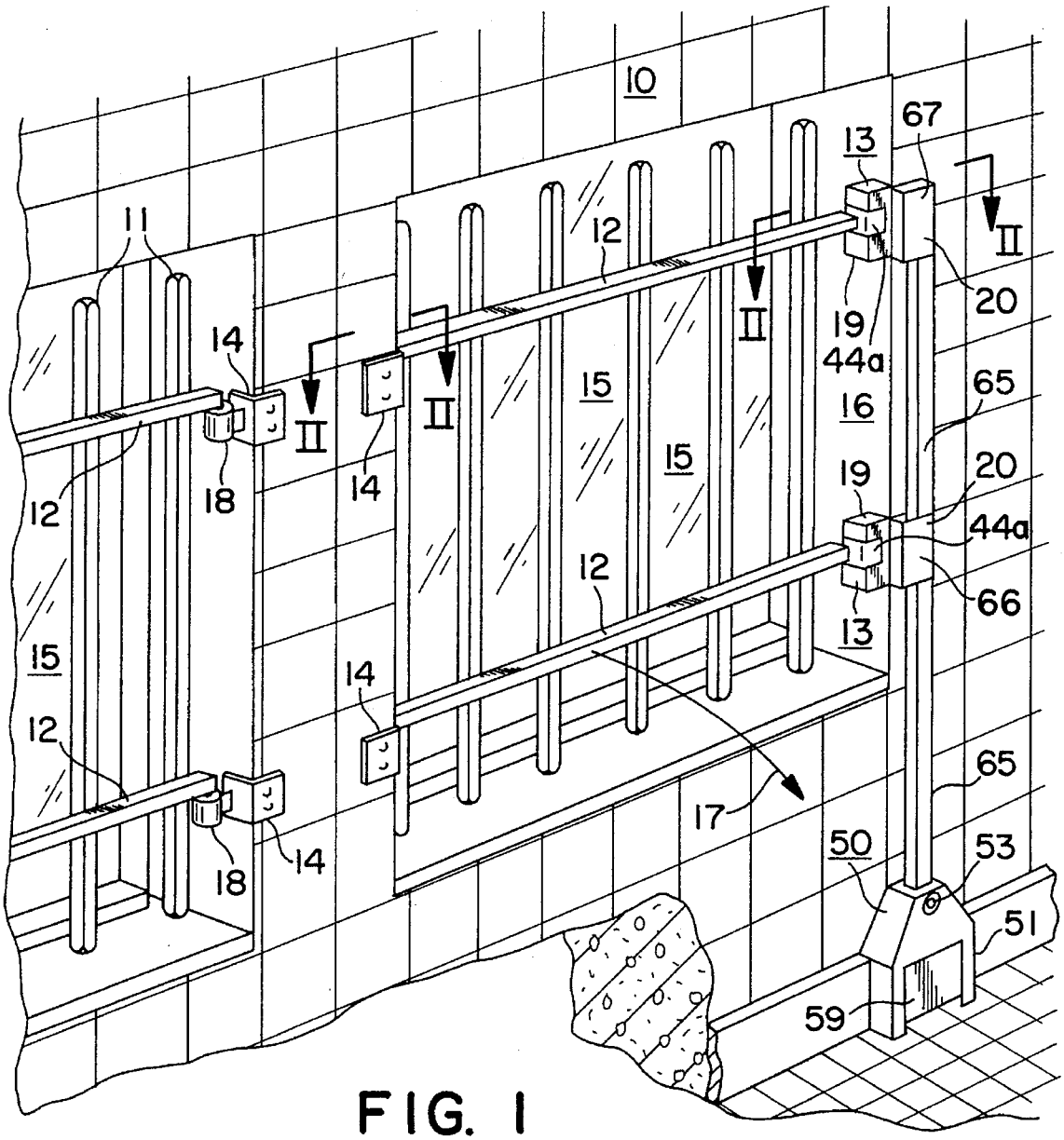
FIG. 1 is a perspective view of a security window grill assembly supported by two hinged wall mounts and two releasable wall mounts on the other side of the grill and a push-plate assembly fitted to the wall below the grill mounts.
Figure 2:
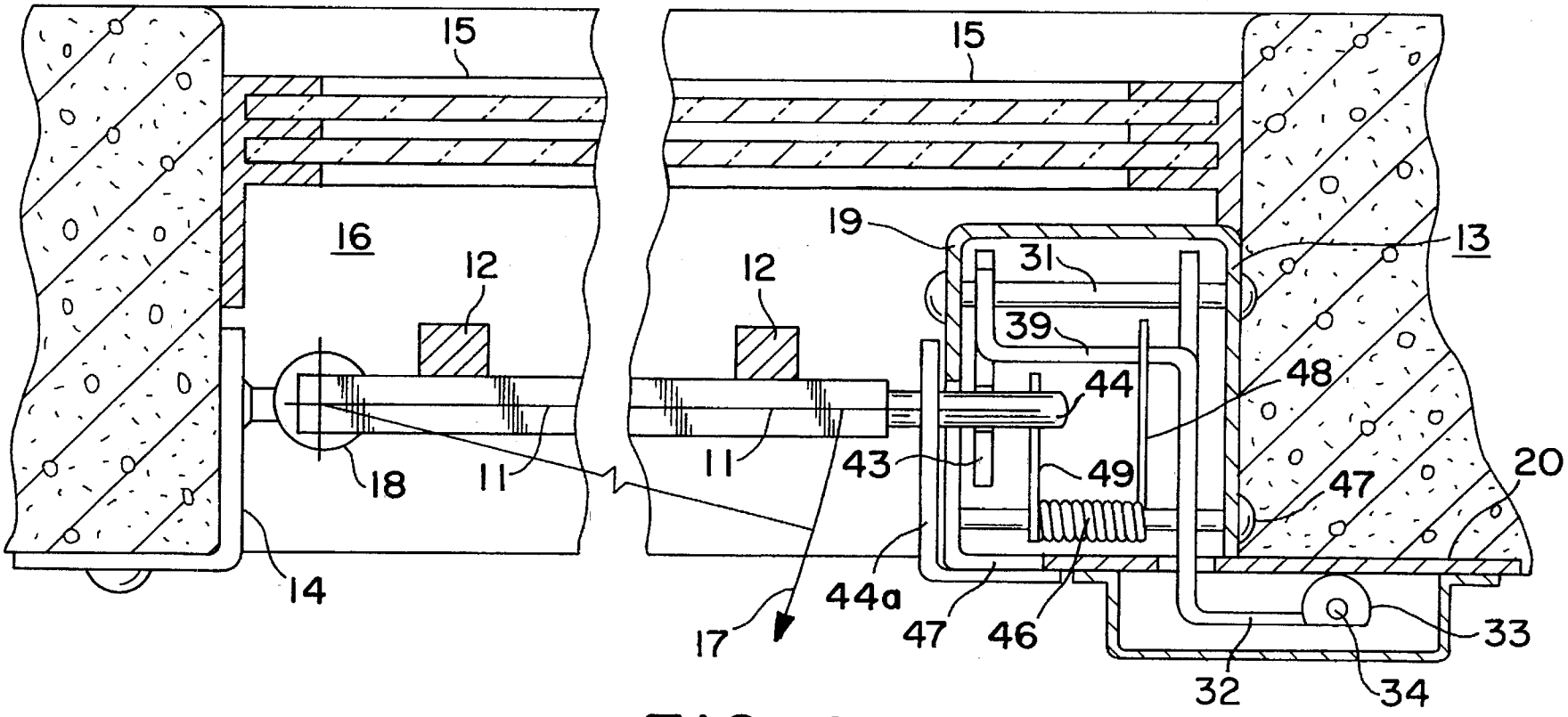
FIG. 2 is a cross-sectional plane view across lines II—II of FIG. 1 showing the mounting means and the release means of the invention system.

The embodiments of the invention are illustrated in the accompanying drawings. As shown in FIG. 1 and FIG. 2, a window grill assembly—10 having vertical bars—11 and horizontal bars—12 is mounted upon two releasable mounts—13 at one side and mounted upon two hinged mounts—14 on the other side in front of a window—15 within the window opening—16. Although the invention releasable mounting system shown in FIG. 1 is utilized in connection with a window grill, the releasable mounting system of the instant invention can be employed in connection with other types of protective covers for covering other types of openings in a wall of a structure. Examples of such openings include, but are not limited to, windows, doors, vents, and the like.

Figure 3:
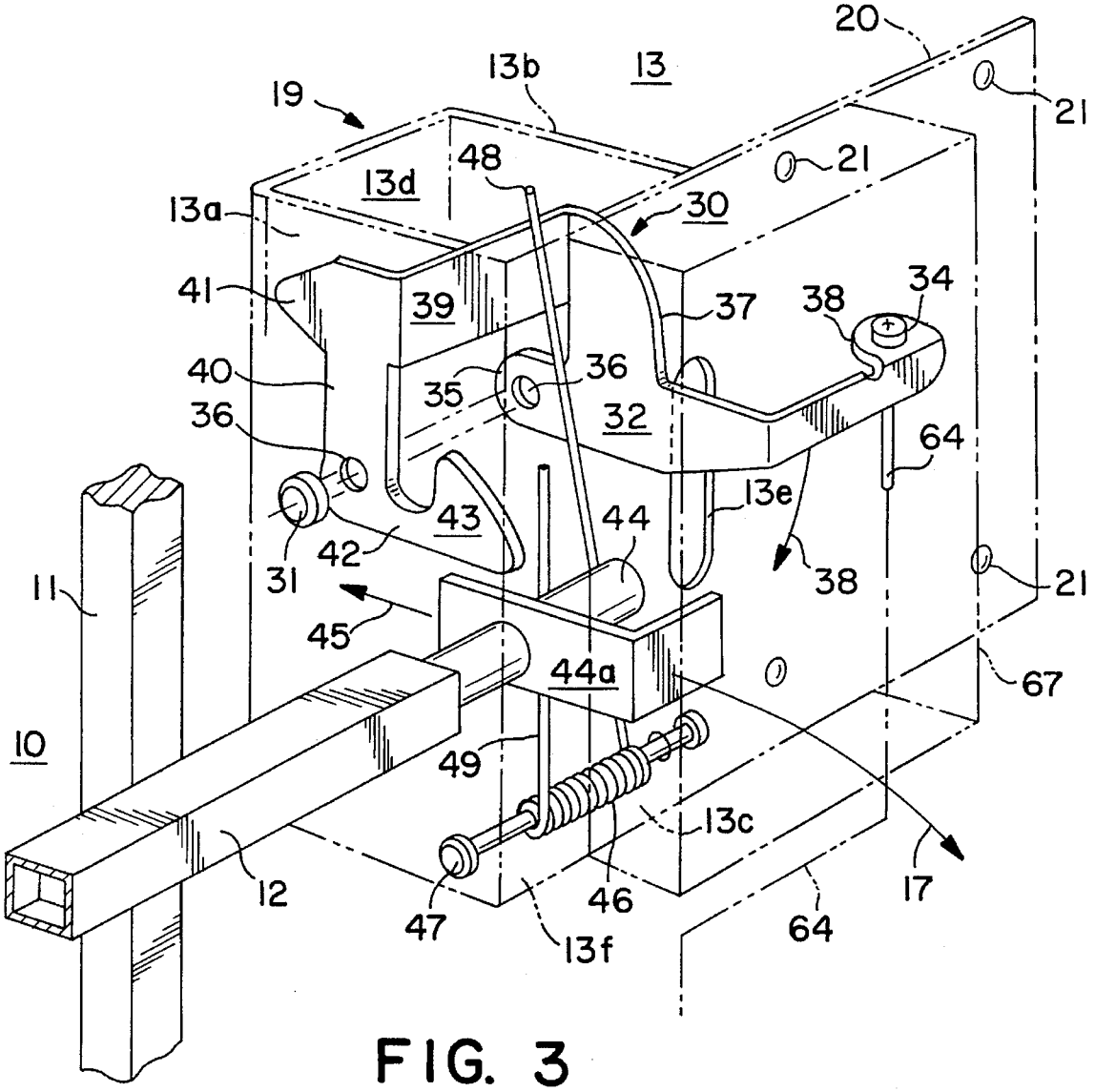
FIG. 3 is a perspective view of the components for the quick release means housed in the release mount, shown in phantom outlines.

The hinged mounts—14 are adapted to pivot about a vertical axis to allow the grill or cover assembly—10 to swing open in direction of arrow—17 or to be removed by lifting the grill or cover out of the hinge socket—19 when necessary to provide unobstructed entry or escape in emergency or other reasons shown in FIG. 2 and FIG. 3. The release mount housing assemblies—13 are attached to a wall—16 and are comprised of an integrally formed enclosure portion having four walls—19 and mounting plate portion—20.

The enclosure portion—19 housing the components of the release means and the mounting plate portion—20 is provided with screw holes—21 for appropriate fastening means to secure the release mount housing assembly—13 to the wall.

The release means is comprised of a latch member—30, shaped and formed integral for its multiple functions and separation biasing means—46.

The latch member—30 is pivotally mounted between housing enclosure side wall—13*a* and side wall—13*b* by pivot pin—31 as shown. The latch member is comprised of a lever segment—32 formed to extend outward after assembly, through opening—13*e* of housing enclosure front wall—13*c* and bend for positioning parallel to mounting plate portion—20. The end of extended lever segment—32 is formed into a laterally projecting grommet—38, with hole—34 for receiving connecting means—64. The remotely disposed end—35 of lever segment—32 has a hub—36 for receiving pivot pin—31. The curved vertical portion—37 of the lever segment—32 defining the latch member—30 provides clearance of latch member toward housing front wall—13*c* when tilted in direction of arrow—38. The central bridge member—39 of the latch member—30 connects the lever segment—32 with the catch segment comprising a vertical portion—40 having, at the upper end thereof, a stop nose—41, and at the lower end a hub hole—36 and a horizontal portion having a substantially U-shaped channel—42 with an upwardly curving latch cam—43 at the free end.

The central bridge member—39 further provides resistance and rest to the first spring arm—48. The stop nose—41 extends backwards from the vertical portion of the catch segment—40 and rests, through the force exerted by the first spring arm, against the inside of housing back wall—13*d* in the cocked position to control correct positioning of the horizontal portion of the catch segment having the U-shaped channel—42 with latch cam—43 to actuate latch member tilt in direction of arrow—38 when the latch pin—44 secured to the protective cover—10 is pushed in direction of arrow—45 for closing and locking the protective cover. A pre-tensioned coiled torsion spring—46 is mounted on a pivot pin—47 within the lower portion of housing enclosure and is positioned below and parallel to the pivot pin—31 securing the latch member—30.

The short spring arm—49 rests against housing front wall 13*c* when in open or unengaged mode and is urged rearward upon entry of the latch pin and will thus exert force against the latch pin—44 when in closed or engaged mode. The latch pin—44 is provided with an angular shaped shield—44*a* to cover the latch pin window in housing corner 13*f* shown in FIG. 2 when the protective covering is closed and locked.

Figure 4:
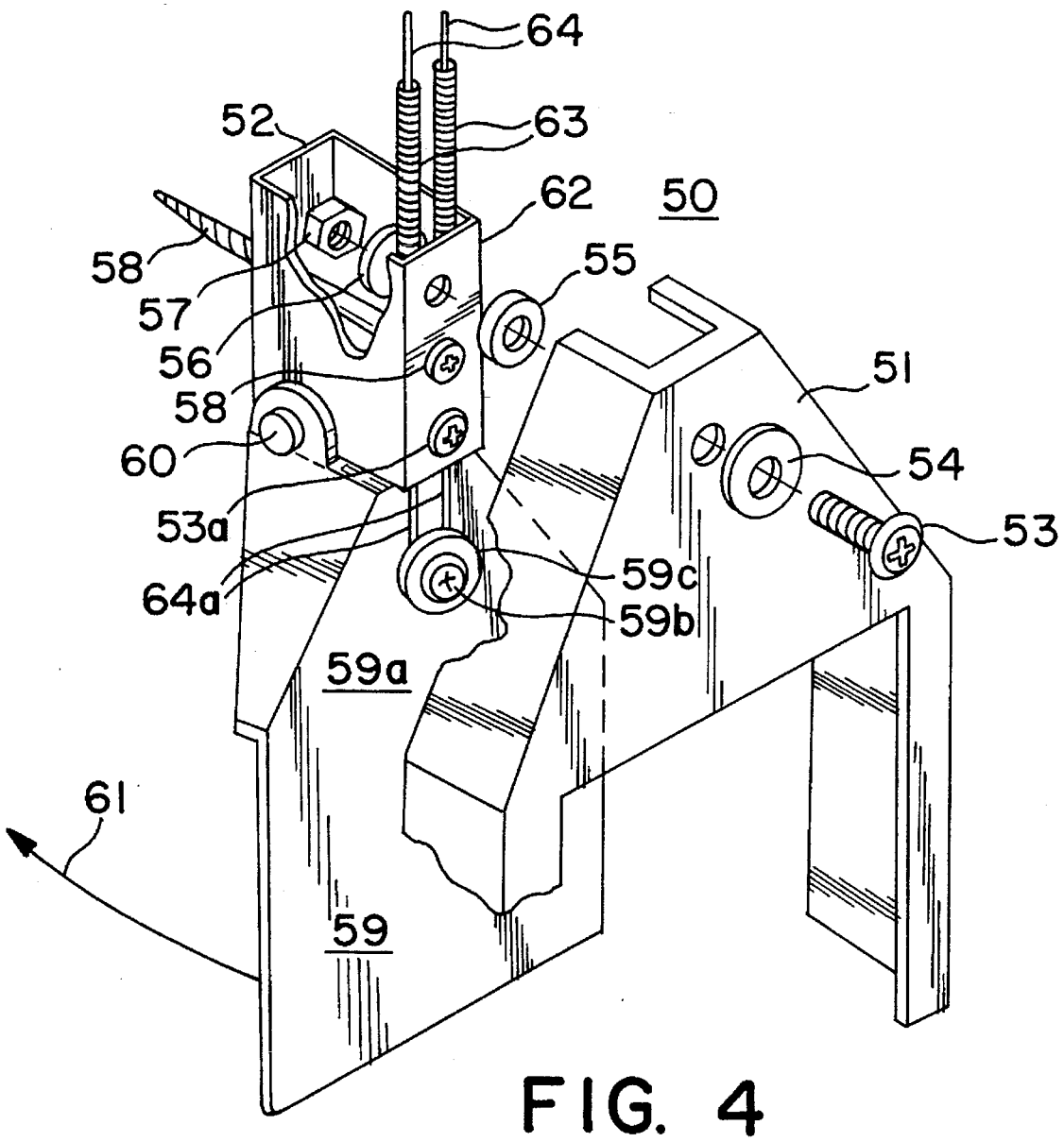
FIG. 4 is a perspective view of the push-plate assembly.

Shown in FIG. 4 are the embodiments of the push-plate assembly—50 which are comprised of a housing—51 and a plate mount—52 attached to each other by a screw 53 with a washer—54, spacer—55, clamp washer—56 and lock nut—57. A screw—58 extending through mount housing—52 for wall mount of push-plate assembly—50, the push-push-plate—59 is pivotally attached to mount—52 by pivot rod—60 to be pivoted in direction of arrow—61 to activate the release means.

A cable assembly—62 is comprised of cable conduits—63 and cables—64. The cable conduits—63 are clamped against the inner wall of mount—52 by screw assembly—53 and screw clamp assembly—53*a*. The cable ends or loops—64*a* are fastened to the upper portion—59*a* of push-plate 59 by screw 59*b* and lock washer—59*c*.

As shown in FIG. 1, a cover duct—65 is fitted between push-plate housing—51 and release mount housing assembly—66 and—67 for cable protection and function.

Shown in FIG. 3, the latch pin—44 secured to the protective cover—10 at this stage is located in front of the second spring arm—49 of torsion spring—46. By closing the protective cover—10, the latch pin—44 will move in direction of arrow 45, tensioning the already loaded spring—46 and engage and lock in the U-shaped channel of the catch segment—42 as shown in FIG. 2.

To release and open the protective cover, the push-plate—59 of assembly—50 is pushed in direction of arrow—61 imparting a pulling movement on the cables—64, pulling the grommet—38 on the lever segment—32, thereby releasing the latch pin—44 of the protective cover—10 and the pressure exerted by the second spring arm—49 against the latch pin—44 will drive the protective cover open in the direction of arrow—17 to provide egress through a particular opening.

In a preferred embodiment a protective covering is mounted over a window, door or other opening in a building on at least one releasable mount so that the cover can be opened from inside the building with minimal effort. In one preferred form of the invention, suitable for most covering applications, the cover is mounted on four mounts, two along one edge of the cover being releasable, and two on the opposite edge being hinged so that when the releasable mounts are released, the cover may swing open to allow emergency egress through the particular opening. The two releasable mounts are also adapted so that they release simultaneously. In other forms, the cover may be mounted on only one releasable mount, or even all releasable mounts.

A releasable mounting system according to the present invention includes a housing assembly or wall-mounted portion that is adapted to attach rigidly to the wall of a building adjacent to a window, door or other opening to be covered, and a protective cover-mounted portion that is attached to the protective cover and is adapted to releasably connect with the wall-mounted portion in a connected position. From the connected position, the mount is released with a remote actuating mechanism through which a small releasing force is applied to the mount.

The housing assembly includes a mounting portion adapted to attach to a wall and an integrally formed enclosure having four walls. Release means including a latch member and separation biasing means are pivotally mounted within the housing enclosure. The latch member is movably mounted generally for movement between a release and a cocked position, between opposite side walls of the housing enclosure. A separation biasing means, such as a suitable spring, biases the latch member in its cocked position, which is generally toward the wall on which the housing assembly is secured.

The cover-mounted portion of the releasable mounting system includes a latch pin that is adapted to be inserted to a latching position through an opening in the housing assembly enclosure portion and for nesting engagement within the U-shaped channel located on the catch segment of the latch member. The latch pin is shaped and oriented to be received through the opening in the housing assembly, slidingly engaging the latch cam, whereupon it is deposited into and nestingly engaged in the adjacent U-shaped channel on the catch segment portion of the latch member when the latch pin is inserted to the latching position.

The releasable mounting system also preferably includes a latch pin housing, including at least a base plate extending substantially transversely from the latch pin. Preferably, the latch pin housing also includes a shield portion that is adapted to overlap with the fixed housing when the latch pin is inserted to the latch position. The latch pin housing combines with the housing assembly enclosure to securely house the latch pin, latch mechanism and biasing means so that they cannot be reached and tampered with. Together, the latch pin housing and the release mount housing assembly also serve to seal the inner mechanisms of the releasable mount when the latch pin is inserted to the latch position, to prevent moisture or other potentially damaging foreign material from reaching the housed parts.

Preferably, a separation biasing means, such as a suitable spring, biases the latch pin and the fixed housing away from each other when the latch pin is in the latched position. The energy stored in the separation biasing means causes the latch pin, and the cover on which it is mounted, to spring away from the fixed housing assembly when the latch member is activated by the remote actuating means, and the mount thereby released. Thus, when released, the mounts according to the invention, enable the protective covering to swing open, allowing egress through the formerly covered opening. As used herein, "separation biasing means" includes suitable springs, such as, for example, coiled springs, torsion springs, tension springs, and the like.

In a preferred embodiment, the separation biasing means comprises a torsion spring. The torsion spring is pivotally mounted upon a pivot pin extending transversely therethrough, the pivot pin securing the torsion spring to opposing side walls within the housing assembly enclosure at a position below and parallel to the pivotally secured latch member. Preferably the torsion spring has a coiled portion and a pair of integrally formed spring arms depending vertically from the remotely disposed ends thereof. The first spring arm is adapted to rest against the central bridge member adjacent to the lever segment of the latch member. The energy stored in the first spring arm exerts pressure on the central bridge member thereby driving the stop nose on the catch segment against the back wall of the housing assembly enclosure. The second spring arm is adapted to rest against the front wall of the housing assembly. The second spring arm intersecting the opening on the housing assembly for receiving the latch pin. The second spring arm is adapted for rearward movement by the latch pin upon entry of the latch pin into the latched position. Thus, the energy stored in the second spring arm, when in a latched position, drives the latch pin out of and away from the housing assembly to an unlatched position upon release.

The mount also includes a remote actuating assembly that connects to the latch member of the releasable mount. The remote actuating assembly is mounted on a wall of a structure, adjacent to the opening to be covered, where it can easily be reached. Generally, each protective cover will be mounted on at least two releasable mounts, and where multiple releasable mounts are used, the remote actuating means preferably connects to the latch member of each mount, and enables simultaneous release of the mounts.

The remote actuating assembly further includes a cable assembly connecting the push-plate to the latch member so that when the push-plate moves from the substantially vertical cocked position to the pivoted release position, the cable is pulled a sufficient distance to move the latch member from the cocked position to the release position.

The cable assembly comprising at least one cable housed in a suitable conduit, such as the conduit 63 shown in FIG. 4. Although the term "cable" has been used herein, it should be understood that any relatively strong and flexible single strand wire or line may be used as an alternative to a braided cable or cord.

In a preferred form of the invention, the remote actuating assembly includes a suitable actuating cable connected at one end to the latch member of the releasable mount. At its other end the cable is connected to a pivoting push-plate of a push-plate assembly. The push-plate assembly is preferably mounted low on the inside surface of the wall having the covered window, door or other opening. The push-plate is adapted for imparting a pulling movement on the cable, when the push-plate is lightly pushed. This movement pulls the latch member from its cocked position to its release position, wherein the lever segment and the catch segment to retract, thereby enabling the latch pin to separate from the fixed housing.

In an alternative preferred mode of the invention, a cover duct is fitted between the push-plate housing and the housing assembly of the releasable mount for concealing and protecting the cable contained therein.

Although the invention has been described with reference to the disclosed embodiments, those skilled in the art will readily appreciate that the specific embodiments described hereinabove are only illustrative of the invention. It should be understood that various modifications can be made without departing from the spirit of the invention. Accordingly, the invention is limited only by the following claims.

What is claimed is:

1. A releasable mounting system for retaining a protective cover over an opening in a wall of a structure comprising:

a latch pin adapted to be rigid connected to the protective cover, the cover being positioned over the opening when the latch pin is in a latched position, a housing assembly comprising a mounting portion having appropriate fastening means adapted for rigid attachment to a wall, and an integrally formed enclosure portion having four walls and at least one opening therein for receiving the latch pin, release means pivotally mounted inside the housing assembly comprising a latch member, wherein the latch member includes:

i.) a lever segment having a horizontal portion comprising a laterally projecting grommet for receiving a first coupling means connecting the latch member to the remote actuating means, a hub having a through-hole for receiving a second coupling means for pivotal positioning of the latch member in the housing assembly, and a vertical portion configured to provide clearance from a first wall of the housing assembly, ii.) a catch segment comprising a vertical portion having, at one end, a rearwardly extending stop nose configured to rest against a third wall of the housing assembly for permitting correct positioning of the latch member and, at an opposite end of the vertical portion, a through-hole for receiving the second coupling means for pivotal positioning of the latch member in the housing assembly, and a horizontal portion comprising a centrally located U-shaped channel for receiving and nestingly engaging the latch pin, and a free end configured to form an upwardly curving cam for slidingly engaging and guiding the latch pin into the U-shaped channel and for retaining the latch pin therein so that the latch pin may not be withdrawn from the latched position, and iii.) a central bridge member connecting adjacent sides of the lever segment and the catch segment defining the latch member;

separation biasing means adapted for movement of the latch member from a release position to a cocked position and for movement of the latch pin away from the housing assembly when the latch member is in a release position, and remote actuating means connected to the latch member for activation of the release means driving the latch pin out of and away from the housing assembly to an unlatched position.

2. The releasable mounting system of claim 1 wherein the housing assembly further comprises a second opening for receiving a free end of the lever segment.

3. The releasable mounting system of claim 1 wherein the first coupling means comprises a cable secured within the laterally projecting grommet on the lever segment of the latch member connecting the latch member to the remote actuating means.

4. The releasable mounting system of claim 1 wherein the second coupling means comprises a pivot pin extending transversely through the through-holes on the lever segment and the catch segment defining the latch member, thereby pivotally securing the latch member within the housing assembly.

5. The releasable mounting system of claim 1 wherein the separation biasing means comprises a torsion spring pivotally mounted on a pivot pin extending transversely therethrough securing the spring within the housing assembly below and parallel to the pivotally secured latch member, the torsion spring comprising a coiled portion and a pair of integrally formed spring arms depending vertically therefrom, the spring arms comprising a first spring arm adapted to rest against the central bridge member adjacent to the lever segment of the latch member, and a second spring arm adapted to rest against the first wall of the housing assembly and traversing the opening for receiving the latch pin positioned thereon, the second spring arm adapted to rearward movement by the latch pin upon entry of the latch pin into the latched position.

6. The releasable mounting system of claim 1 wherein the latch pin further comprises an overlapping shield shaped and oriented to cover the opening for receiving the latch pin positioned on the housing assembly when the latch pin is in the latched position.

7. The releasable mounting system of claim 1 wherein the remote actuating means comprises a push-plate assembly mounted on a wall in the structure adjacent to the opening, the push-plate assembly having coupling means for connecting the remote actuating means to the latch member.

8. The releasable mounting system of claim 7 wherein the coupling means comprises a cable assembly.

9. The releasable mounting system of claim 8, wherein the cable assembly comprises at least one cable conduit and at least one cable connecting the push-plate assembly to the latch member so that when the push-plate assembly moves from a substantially vertical cocked position to a pivoted release position the cable is pulled a sufficient distance to move the latch member from the cocked position to the release position.

10. The releasable mounting system of claim 7 wherein the push-plate assembly comprises:

a housing and mount adapted to be rigidly secured to an inside surface of the wall, and a push-plate pivotally mounted on the mount for movement between a substantially vertical cocked position and a release position pivoted toward the wall.

11. The releasable mounting system of claim 7 further comprising a cover duct fitted over the coupling means between the push-plate assembly and the housing assembly.

12. A releasable mounting system for mounting a window grill over a window comprising:

a housing assembly comprising a mounting portion having appropriate fastening means adapted for rigid attachment to a wall adjacent to the window, and an integrally formed contiguous enclosure portion having four walls having a first opening traversing a first portion of a first wall and extending transversely onto an adjacent second wall and a second opening traversing a second portion of the first wall, release means pivotally mounted inside the housing assembly comprising a latch member, wherein the latch member includes:

i.) a lever segment having a horizontal portion extending outward through the second opening of the housing assembly and bending for positioning parallel to the mounting portion of the housing assembly forming a laterally projecting grommet for receiving a first coupling means for connecting the latch member to a remote actuating means, a hub having a through-hole for receiving a second coupling means for pivotal positioning of the latch member in the housing assembly, and a vertical portion configured to provide clearance from the first wall of the housing assembly, ii.) a catch segment comprising a vertical portion having, at one end, a rearwardly extending stop nose configured to rest against a third wall of the housing assembly for permitting correct positioning of the latch member and, an opposite end of the vertical portion having a through-hole for receiving the second coupling means for pivotal positioning of the latch member in the housing assembly, and a horizontal portion comprising a centrally located U-shaped channel for receiving and nestingly engaging a latch pin, and a free end configured to form an upwardly curving cam for slidingly engaging and guiding a latch pin into the U-shaped channel and for retaining a latch pin therein so that a latch pin may not be withdrawn from a latched position, and iii.) a central bridge member connecting adjacent sides of the lever segment and the catch segment defining the latch member;

separation biasing means adapted for movement of the latch member from a release position to a cocked position and for movement of the window grill away from the housing assembly when the latch member is in a release position, a latch pin adapted to be rigidly connected to the window grill and adapted to be received through the first opening of the housing assembly enclosure for nesting engagement by the release means to a latched position, the grill being positioned over the window when the latch pin is in the latched position, and remote actuating means connected to the latch member for activation of the release means for driving the latch pin out of and away from the housing assembly to an unlatched position.

13. The releasable mounting system of claim 12 wherein the first coupling means comprises a cable secured within the laterally projecting grommet on the lever segment of the latch member connecting the latch member to the remote actuating means.

14. The releasable mounting system of claim 12 wherein the second coupling means comprises a pivot pin extending transversely through the through-holes on the lever segment and the catch segment, thereby, pivotally securing the latch member within the housing assembly.

15. The releasable mounting system of claim 12 wherein the separation biasing means comprises a torsion spring pivotally mounted on a pivot pin extending transversely therethrough for securing the spring within the housing assembly below and parallel to the pivotally secured latch member, the torsion spring having a coiled portion and a pair of integrally formed spring arms depending vertically therefrom, the spring arms comprising a first spring arm adapted to rest against the central bridge member adjacent to the lever segment of the latch member and a second spring arm adapted to rest against the first wall of the housing assembly and traversing the first opening positioned thereon, the second spring arm adapted to rearward movement by the latch pin upon entry of the latch pin into the latched position.

16. The releasable mounting system of claim 15 wherein the torsion spring is pre-tensioned.

17. The releasable mounting system of claim 12 wherein the latch pin further comprises an overlapping shield shaped and oriented to cover the first opening traversing the housing assembly when the latch pin is in the latched position.

18. The releasable mounting system of claim 12 wherein the remote actuating means comprise a push-plate assembly mounted on the wall near a floor adjacent to the window, the push-plate assembly having coupling means for connecting the remote actuating means to the latch member.

19. The releasable mounting system of claim 18 wherein the coupling means comprise a cable assembly.

20. The releasable mounting system of claim 19, wherein the cable assembly comprises at least one cable conduit and at least one cable connecting the push-plate assembly to the latch member so that when the push-plate assembly moves from a substantially vertical cocked position to a pivoted release position the cable is pulled a sufficient distance to move the latch member from the cocked position to the release position.

21. The releasable mounting system of claim 18 wherein the push-plate assembly comprises:

a housing and mount adapted to be rigidly secured to an inside surface of the wall, and a push-plate pivotally mounted on the mount for movement between a substantially vertical cocked position and a release position pivoted toward the wall.

22. The releasable mounting system of claim 18 further comprising a cover duct fitted over the coupling means between the push-plate assembly and the housing assembly.

* * * * *